US007563179B2

(12) United States Patent
Shindo et al.

(10) Patent No.: US 7,563,179 B2
(45) **Date of Patent: *Jul. 21, 2009**

(54) GOLF BALL

(75) Inventors: Jun Shindo, Chichibu (JP); Eiji Takehana, Chichibu (JP); Kae Yamazaki, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 67 days.

This patent is subject to a terminal disclaimer.

(21) Appl. No.: 11/878,952

(22) Filed: Jul. 27, 2007

(65) Prior Publication Data

US 2008/0076603 A1 Mar. 27, 2008

Related U.S. Application Data

(63) Continuation-in-part of application No. 11/324,297, filed on Jan. 4, 2006, now Pat. No. 7,294,067.

(30) Foreign Application Priority Data

Jul. 2, 2007 (JP) ..... 2007-173986

(51) Int. Cl.
*A63B 37/00* (2006.01)

(52) U.S. Cl. ..... 473/351

(58) Field of Classification Search ..... 473/351, 473/367, 368

See application file for complete search history.

(56) References Cited

U.S. PATENT DOCUMENTS

| | | | | |
|---|---|---|---|---|
| 6,184,276 | B1 | 2/2001 | Ignatz-Hoover | |
| 6,194,505 | B1 * | 2/2001 | Sone et al. | 524/432 |
| 6,277,924 | B1 | 8/2001 | Hamada et al. | |
| 6,372,847 | B1 | 4/2002 | Wouters | |
| 6,596,801 | B2 * | 7/2003 | Higuchi et al. | 524/432 |
| 6,602,941 | B2 | 8/2003 | Higuchi et al. | |
| 6,634,961 | B2 | 10/2003 | Higuchi et al. | |
| 6,695,716 | B2 | 2/2004 | Higuchi et al. | |
| 6,712,715 | B2 | 3/2004 | Higuchi et al. | |
| 6,786,836 | B2 | 9/2004 | Higuchi et al. | |
| 6,795,172 | B2 | 9/2004 | Putman et al. | |
| 6,818,705 | B2 | 11/2004 | Wu et al. | |
| 6,841,642 | B2 | 1/2005 | Kaszas | |
| 6,921,345 | B2 | 7/2005 | Higuchi et al. | |
| 6,923,735 | B1 | 8/2005 | Hayashi | |
| 7,250,010 | B1 * | 7/2007 | Shindo et al. | 473/351 |
| 7,294,067 | B2 * | 11/2007 | Shindo et al. | 473/351 |
| 2004/0147694 | A1 | 7/2004 | Sone et al. | |
| 2005/0148723 | A1 | 7/2005 | Kondou | |
| 2007/0203277 | A1 * | 8/2007 | Chen | 524/322 |

FOREIGN PATENT DOCUMENTS

| | | | |
|---|---|---|---|
| JP | 7-268132 | A | 10/1995 |
| JP | 11-35633 | A | 2/1999 |
| JP | 2002-355336 | A | 12/2002 |
| JP | 2002-355337 | A | 12/2002 |
| JP | 2002-355338 | A | 12/2002 |
| JP | 2002-355339 | A | 12/2002 |
| JP | 2002-355340 | A | 12/2002 |
| JP | 2002-356581 | A | 12/2002 |
| JP | 2004-292667 | A | 10/2004 |
| WO | WO 03/082925 | | 10/2003 |

OTHER PUBLICATIONS

"Report of Research & Development", Fine Chemical, vol. 23, No. 9, p. 5-15 (1994).

"Hydrolysis of Tri-tert-butylaluminum" by Mason et al., J. American Chemical Society, vol. 115, pp. 4971-4984 (1993).

"Three-Coordinate Aluminum Is Not a Prerequisite for Catalytic Activity in the Zirconocene-Alumoxane Polymerization of Ethylene", by Harlen et al, J. American Chemical Society, vol. 117, pp. 6465-6474, (1995).

* cited by examiner

*Primary Examiner*—Raeann Trimiew
(74) *Attorney, Agent, or Firm*—Sughrue Mion, PLLC

(57) ABSTRACT

The present invention provides a golf ball having a core and a cover of one or more layer, wherein the core is made of a material obtained by molding under heat a rubber composition which includes (a) a base rubber containing polybutadiene having a stress relaxation time ($T_{80}$) of 3.5 or less, (b) an unsaturated carboxylic acid and/or a metal salt thereof, and (c) an organic peroxide, and wherein at least one layer of the cover is made of a material obtained by molding a mixture composed of (A) 100 parts by weight of a base resin and (B) 1 to 40 parts by weight of a branched saturated fatty acid or a derivative thereof. The golf ball has an excellent rebound overall, a soft, pleasant feel on impact, and excellent scuff resistance. Moreover, it has an appearance with a high degree of whiteness.

10 Claims, No Drawings

GOLF BALL

CROSS-REFERENCE TO RELATED APPLICATION

This application is a continuation-in-part of application Ser. No. 11/324,297 filed on Jan. 4, 2006, now U.S. Pat. No. 7,294,067 the entire contents of which are hereby incorporated by reference.

This application claims priority under 35 U.S.C. §119(a) on Patent Application No. 2007-173986 filed in Japan on Jul. 2, 2007, the entire contents of which are hereby incorporated by reference.

BACKGROUND OF THE INVENTION

The present invention relates to a golf ball having an excellent rebound.

Efforts to confer golf balls with an excellent rebound have until now focused on and attempted to optimize one or more indicator of the polybutadiene used as the base rubber, such as the Mooney viscosity, polymerization catalyst, solvent viscosity and molecular weight distribution. See, for example, Patent Document 1: JP-A 2004-292667; Patent Document 2: U.S. Pat. No. 6,818,705; Patent Document 3: JP-A 2002-355336; Patent Document 4: JP-A 2002-355337; Patent Document 5: JP-A 2002-355338; Patent Document 6: JP-A 2002-355339; Patent Document 7: JP-A 2002-355340; and Patent Document 8: JP-A 2002-356581.

For example, Patent Document 1 (JP-A 2004-292667) describes, as a base rubber for golf balls, a polybutadiene having a Mooney viscosity of 30 to 42 and a molecular weight distribution (Mw/Mn) of 2.5 to 3.8. Patent Document 2 (U.S. Pat. No. 6,818,705) describes, for the same purpose, a polybutadiene having a molecular weight of at least 200,000 and a resilience index of at least 40.

However, because many golfers desire golf balls capable of traveling a longer distance, there exists a need for the development of golf balls having an even better rebound.

Patent Document 1: JP-A 2004-292667
Patent Document 2: U.S. Pat. No. 6,818,705
Patent Document 3: JP-A 2002-355336
Patent Document 4: JP-A 2002-355337
Patent Document 5: JP-A 2002-355338
Patent Document 6: JP-A 2002-355339
Patent Document 7: JP-A 2002-355340
Patent Document 8: JP-A 2002-356581

SUMMARY OF THE INVENTION

It is therefore an object of the present invention to provide a golf ball having an excellent rebound.

As a result of extensive investigations, the inventor has discovered that, in a golf ball composed of a core and a cover of one or more layers, by having the core made of a material obtained by molding under heat a rubber composition which includes a base rubber containing a polybutadiene having a specific $T_{80}$ value, an unsaturated carboxylic acid and/or a metal salt thereof, and an organic peroxide, and by having at least one layer of the cover made of a material obtained by molding a mixture containing, as the essential ingredients, (A) 100 parts by weight of a base resin and (B) from 1 to 40 parts by weight of a branched saturated fatty acid or a derivative thereof, a good ball rebound is maintained. The golf ball of the invention has also been found to have a good feel on impact and an excellent scuff resistance.

Accordingly, the invention provides the following golf ball.

[1] A golf ball comprising a core and a cover of one or more layer, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide, and wherein at least one layer of the cover is made of a material obtained by molding a mixture comprising (A) 100 parts by weight of a base resin and (B) 1 to 40 parts by weight of a branched saturated fatty acid or a derivative thereof.

[2] The golf ball of [1], wherein the rubber composition further comprises (d) an organosulfur compound.

[3] The golf ball of [1], wherein the polybutadiene having a stress relaxation time ($T_{80}$) of 3.5 or less accounts for at least 40 wt % of the base rubber.

[4] The golf ball of [1], wherein the polybutadiene having a stress relaxation time ($T_{80}$) of 3.5 or less is a polybutadiene prepared using a rare-earth catalyst.

[5] The golf ball of [1], wherein the polybutadiene having a stress relaxation time ($T_{80}$) of 3.5 or less is a polybutadiene prepared by polymerization using a rare-earth catalyst, followed by terminal modification.

[6] The golf ball of [1], wherein the mixture comprising components A and B further comprises a basic inorganic metal compound capable of neutralizing acid groups in components A and B.

[7] The golf ball of [1], wherein the base resin (A) is one or more selected from among (A1) to (A4) below:

(A1) olefin-unsaturated carboxylic acid random copolymers, (A2) olefin-unsaturated carboxylic acid-unsaturated carboxylic acid ester random copolymers, (A3) metal ion neutralization products of olefin-unsaturated carboxylic acid random copolymers, and (A4) metal ion neutralization products of olefin-unsaturated carboxylic acid-unsaturated carboxylic acid ester random copolymers.

[8] The golf ball of [1], wherein the base resin (A) is (A1) an olefin-unsaturated carboxylic acid random copolymer and/or (A3) a metal ion neutralization product of an olefin-unsaturated carboxylic acid random copolymer.

[9] The golf ball of [1], wherein an outermost layer of the cover is made of the material obtained by molding the mixture comprising components A and B.

[10] The golf ball of [1], wherein the branched saturated fatty acid (B) is at least one selected from the group consisting of isostearic acid, isoarachidic acid, isopalmitic acid, isomyristic acid and isoheptanoic acid.

DETAILED DESCRIPTION OF THE INVENTION

The invention is described more fully below.

The golf ball of the invention has a core and a cover of one or more layer. The core is not limited to only one layer, and may if necessary be composed of two or more layers. The core is made of a material obtained by molding under heat a rubber composition which includes the following components (a) to (c):

(a) a base rubber containing polybutadiene having a stress relaxation time ($T_{80}$), as defined below, of 3.5 or less, (b) an unsaturated carboxylic acid and/or a metal salt thereof, and (c) an organic peroxide.

The stress relaxation time ($T_{80}$) is the time in seconds, from the moment when rotor rotation is stopped immediately after measurement of the $ML_{1+4}$ (100° C.) value (the Mooney viscosity measured at 100° C. in accordance with ASTM D-1646-96), that is required for the $ML_{1+4}$ value to decrease 80%.

The term "Mooney viscosity" used herein refers to an industrial indicator of viscosity as measured with a Mooney viscometer, which is a type of rotary plastometer. The unit symbol used is $ML_{1+4}$ (100° C.), where "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

In the practice of the invention, the polybutadiene in above component (a) includes a polybutadiene having a stress relaxation time ($T_{80}$) of 3.5 or less (which polybutadiene is sometimes abbreviated below as "BR1"). The $T_{80}$ value is preferably 3.0 or less, more preferably 2.8 or less, and even more preferably 2.5 or less. The $T_{80}$ value has a lower limit of preferably 1 or more, and more preferably 1.5 or more. At a $T_{80}$ value of more than 3.5, the objects of the invention cannot be attained. On the other hand, if the $T_{80}$ value is too small, problems may arise with workability.

The foregoing polybutadiene BR1 has a Mooney viscosity ($ML_{1+4}$ (100° C.)) which, while not subject to any particular limitation, is preferably at least 20 but not more than 80.

It is recommended that the above polybutadiene BR1 have a cis-1,4 bond content of preferably 60%, more preferably at least 80%, even more preferably at least 90%, and most preferably at least 95%, and a 1,2-vinyl bond content of preferably at most 2%, more preferably at most 1.7%, even more preferably at most 1.5%, and most preferably at most 1.3%. At a cis-1,4 bond content or a 1,2-vinyl bond content outside of these ranges, the rebound may decrease.

From the standpoint of rebound, it is preferable for the above polybutadiene BR1 used in the invention to be a polybutadiene synthesized using a rare-earth catalyst.

A known rare-earth catalyst may be used for this purpose. Exemplary rare-earth catalysts include those made up of a combination of a lanthanide series rare-earth compound, an organoaluminum compound, an alumoxane, a halogen-bearing compound, and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

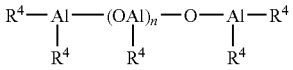

(I)

-continued

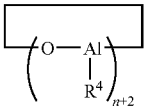

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of preferably from −30 to +150° C., and more preferably from 10 to 100° C.

To manufacture golf balls of stable quality, it is desirable for the above-described polybutadiene BR1 used in the invention to be a terminal-modified polybutadiene obtained by polymerization using the above-described rare-earth catalyst, followed by the reaction of a terminal modifier with active end groups on the polymer.

A known terminal modifier may be used for this purpose. Illustrative examples include compounds of types (1) to (6) below.

(1) Halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(2) heterocumulene compounds having on the molecule a Y=C=Z linkage (wherein Y is a carbon, oxygen, nitrogen or sulfur atom; and Z is an oxygen, nitrogen or sulfur atom);

(3) three-membered heterocyclic compounds containing on the molecule the following bonds

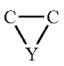

(wherein Y is an oxygen, nitrogen or sulfur atom);

(4) halogenated isocyano compounds;

(5) carboxylic acids, acid halides, ester compounds, carbonate compounds and acid anhydrides of the formula $$R^8—(COOH)_m,\ R^9(COX)_m,\ R^{10}—(COO—R^{11}),\ R^{12}—OCOO—R^{13},\ R^{14}—(COOCO—R^{15})_m \text{ or}$$

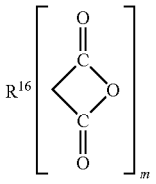

(wherein $R^8$ to $R^{16}$ are each independently a hydrocarbon group of 1 to 50 carbons, X is a halogen atom, and m is an integer from 1 to 5); and (6) carboxylic acid metal salts of the formula $R^{17}_lM''(OCOR^{18})_{4-1}$, $R^{19}_lM''(OCO—R^{20}—COOR^{21})_{4-1}$ or

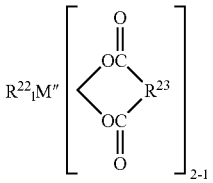

(wherein $R^{17}$ to $R^{23}$ are each independently a hydrocarbon group of 1 to 20 carbons, M" is a tin, silicon or germanium atom, and the letter l is an integer from 0 to 3).

Specific examples of the above terminal modifiers (1) to (6) and methods for their reaction are described in, for example, JP-A 11-35633 and JP-A 7-268132.

In the practice of the invention, the above-described polybutadiene BR1 is included within the base rubber and accounts for preferably at least 40 wt %, more preferably at least 50 wt %, even more preferably at least 60 wt %, and even up to 100 wt %, of the base rubber. If this proportion is too low, the rebound may decrease.

No particular limitation is imposed on rubber compounds other than BR1 which may be included in the base rubber. For example, polybutadiene rubbers having a stress relaxation time $T_{80}$ of more than 3.5 may be included, as can also other rubber compounds such as styrene-butadiene rubbers (SBR), natural rubbers, polyisoprene rubbers and ethylene-propylene-diene rubbers (EPDM). These may be used individually or as combinations of two or more thereof.

The Mooney viscosity of such additional rubbers included in the base rubber, while not subject to any particular limitation, is preferably at least 20 but preferably not more than 80.

Rubbers synthesized with a group VIII catalyst may be used as such additional rubbers included in the base rubber. Exemplary group VIII catalysts include the following nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include cobalt and cobalt compounds such as Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Polymerization using the above group VIII catalysts, and particularly a nickel or cobalt catalyst, can be carried out by a process in which, typically, the catalyst is continuously charged into a reactor together with a solvent and butadiene monomer, and the reaction conditions are suitably selected, such as a reaction temperature in a range of 5 to 60° C. and a reaction pressure in a range of atmospheric pressure to 70 plus atmospheres, so as to yield a product having the above-indicated Mooney viscosity.

Above component (b) may be an unsaturated carboxylic acid, specific examples of which include acrylic acid, methacrylic acid, maleic acid and fumaric acid. Acrylic acid and methacrylic acid are especially preferred. Alternatively, it may be the metal salt of an unsaturated carboxylic acid, examples of which include the zinc and magnesium salts of unsaturated fatty acids such as zinc dimethacrylate and zinc diacrylate. The use of zinc diacrylate is especially preferred.

It is recommended that the content of above component (b) per 100 parts by weight of the base rubber be preferably at least 10 parts by weight, and more preferably at least 15 parts by weight, but preferably not more than 60 parts by weight, more preferably not more than 50 parts by weight, even more preferably not more than 45 parts by weight, and most preferably not more than 40 parts by weight. Too much component (b) will make the material molded under heat from the rubber composition too hard, giving the golf ball an unpleasant feel on impact. On the other hand, too little will result in a lower rebound.

Above component (c) may be a commercially available product, suitable examples of which include Percumyl D (produced by NOF Corporation), Perhexa 3C (NOF Corporation) and Luperco 231XL (Atochem Co.). If necessary, a combination of two or more different organic peroxides may be used.

It is recommended that the amount of component (c) per 100 parts by weight of the base rubber be preferably at least 0.1 part by weight, and more preferably at least 0.3 part by weight, but preferably not more than 5 parts by weight, more preferably not more than 4 parts by weight, even more preferably not more than 3 parts by weight, and most preferably not more than 2 parts by weight. Too much or too little component (c) may make it impossible to obtain a suitable hardness distribution, resulting in a poor feel on impact, durability and rebound.

To further improve rebound, it is desirable for the rubber composition in the invention to include also the following component (d): (d) an organosulfur compound.

Examples of such organosulfur compounds include thiophenols, thionaphthols, halogenated thiophenols, and metal salts thereof. Specific examples include the zinc salts of pentachlorothiophenol, pentafluorothiophenol, pentabromothiophenol and p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. These may be used singly or as combinations of two or more thereof. Diphenyldisulfide and/or the zinc salt of pentachlorothiophenol are especially preferred.

It is recommended that the amount of component (d) included per 100 parts by weight of the base rubber be preferably at least 0.1 part by weight, more preferably at least 0.2 part by weight, and even more preferably at least 0.5 part by weight, but preferably not more than 5 parts by weight, more preferably not more than 4 parts by weight, and even more preferably not more than 3 parts by weight. Too much organosulfur compound may make the material molded under heat from the rubber composition too soft, whereas too little may make an improved rebound difficult to achieve.

The rubber composition in the invention may additionally include such additives as inorganic fillers and antioxidants. Illustrative examples of suitable inorganic fillers include zinc oxide, barium sulfate and calcium carbonate. The amount included per 100 parts by weight of the base rubber is preferably at least 5 parts by weight, more preferably at least 7 parts by weight, even more preferably at least 10 parts by weight, and most preferably at least 13 parts by weight, but preferably not more than 80 parts by weight, more preferably not more than 50 parts by weight, even more preferably not more than 45 parts by weight, and most preferably not more than 40 parts by weight. Too much or too little inorganic filler may make it impossible to obtain a proper golf ball weight and a suitable rebound.

To increase the rebound, it is desirable for the inorganic filler to include zinc oxide in an amount of at least 50 wt %, preferably at least 75 wt %, and most preferably 100 wt % (where the zinc oxide accounts for 100% of the inorganic filler).

The zinc oxide has an average particle size (by air permeametry) of preferably at least 0.01 μm, more preferably at least 0.05 μm, and most preferably at least 0.1 μm, but preferably not more than 2 μm, and more preferably not more than 1 μm.

Examples of suitable commercial antioxidants include 2,2'-methylenebis(4-methyl-6-t-butylphenol) (Nocrac NS-6, available from Ouchi Shinko Chemical Industry Co., Ltd.) and 2,2'-methylenebis(4-ethyl-6-t-butylphenol) (Nocrac NS-5, Ouchi Shinko Chemical Industry Co., Ltd.). To achieve a good rebound and durability, it is recommended that the amount of antioxidant included per 100 parts by weight of the base rubber be preferably more than 0 part by weight, more preferably at least 0.05 part by weight, even more preferably at least 0.1 part by weight, and most preferably at least 0.2 part by weight, but preferably not more than 3 parts by weight, more preferably not more than 2 parts by weight, even more preferably not more than 1 part by weight, and most preferably not more than 0.5 part by weight.

The material molded under heat from the rubber composition in the present invention can be obtained by vulcanizing and curing the rubber composition using a method of the same sort as that used on prior-art rubber compositions for golf balls. Vulcanization may be carried, for example, at a temperature of from 100 to 200° C. for a period of 10 to 40 minutes.

It is recommended that the core (hot-molded material) in the invention have a hardness difference, obtained by subtracting the JIS-C hardness at the center of the hot-molded material from the JIS-C hardness at the surface of the material, of preferably at least 15, more preferably at least 16, even more preferably at least 17, and most preferably at least 18, but preferably not more than 50, and more preferably not more than 40. Setting the hardness within this range is desirable for achieving a golf ball having a soft feel and a good rebound and durability.

It is also recommended that the core (hot-molded material) in the invention have a deflection, when compressed under a final load of 1275 N (130 kgf) from an initial load of 98 N (10 kgf), of preferably at least 2.0 mm, more preferably at least 2.5 mm, and even more preferably at least 2.8 mm, but preferably not more than 6.0 mm, more preferably not more than 5.5 mm, even more preferably not more than 5.0 mm, and most preferably not more than 4.5 mm. Too small a deflection may worsen the feel of the ball on impact and, particularly on long shots such as with a driver in which the ball incurs a large deformation, may subject the ball to an excessive rise in spin, shortening the distance traveled by the ball. On the other hand, a hot-molded material that is too soft may deaden the feel of the golf ball when played and compromise the rebound of the ball, resulting in a shorter distance, and may give the ball a poor durability to cracking with repeated impact.

It is recommended that the core have a diameter of preferably at least 30.0 mm, more preferably at least 32.0 mm, even more preferably at least 35.0 mm, and most preferably at least 37.0 mm, but preferably not more than 41.0 mm, more preferably not more than 40.5 mm, even more preferably not more than 40.0 mm, and most preferably not more than 39.5 mm.

In particular, it is recommended that such a solid core in a solid two-piece golf ball have a diameter of preferably at least 37.0 mm, more preferably at least 37.5 mm, even more preferably at least 38.0 mm, and most preferably at least 38.5 mm, but preferably not more than 41.0 mm, more preferably not more than 40.5 mm, and even more preferably not more than 40.0 mm.

Similarly, it is recommended that such a solid core in a solid three-piece golf ball have a diameter of preferably at least 30.0 mm, more preferably at least 32.0 mm, even more preferably at least 34.0 mm, and most preferably at least 35.0 mm, but preferably not more than 40.0 mm, more preferably not more than 39.5 mm, and even more preferably not more than 39.0 mm.

It is also recommended that the core have a specific gravity of preferably at least 0.9, more preferably at least 1.0, and even more preferably at least 1.1, but preferably not more than 1.4, more preferably not more than 1.3, and even more preferably not more than 1.2.

Next, in the present invention, at least one layer of the cover of one or more layers is made of a cover material composed of, in admixture, (A) 100 parts by weight of a base resin and (B) from 1 to 40 parts by weight of a branched saturated fatty acid or a salt thereof.

A thermoplastic resin or a thermoplastic elastomer may generally be used as the base resin serving as component A. Of these, the base resin (A) is one or more selected from among (A1) to (A4) below:

(A1) olefin-unsaturated carboxylic acid random copolymers, (A2) olefin-unsaturated carboxylic acid-unsaturated carboxylic acid ester random copolymers, (A3) metal ion neutralization products of olefin-unsaturated carboxylic acid random copolymers, and (A4) metal ion neutralization products of olefin-unsaturated carboxylic acid-unsaturated carboxylic acid ester random copolymers.

Here, the olefin in component A is generally one having at least 2 carbons, but not more than 8 carbons, and preferably not more than 6 carbons. Illustrative examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are preferred.

The unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Of these, butyl acrylate (n-butyl acrylate, i-butyl acrylate, tert-butyl acrylate) is especially preferred.

The random copolymers of components A1 and A2 of the invention may be obtained by random copolymerization of the foregoing ingredients according to a known method. It is recommended that the content of unsaturated carboxylic acid (acid content) included in the random copolymer be preferably at least 2 wt %, more preferably at least 6 wt %, and even more preferably at least 8 wt %, but not more than 25 wt %, preferably not more than 20 wt %, and more preferably not more than 18 wt %. If the acid content is too low, the rebound resilience may decrease. On the other hand, if the acid content is too high, the processability may decrease.

The random copolymer neutralization products of components A3 and A4 of the invention may be obtained by neutralizing some of the acid groups on the random copolymer with metal ions. Illustrative examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$ and $Mg^{++}$ are preferred, and $Zn^{++}$ is especially preferred. The degree to which the random copolymer is neutralized by these metal ions is not subject to any particular limitation. The neutralization product may be obtained by a known method, such as one that involves introducing to the random copolymer a suitable compound, examples of which include formates, acetates, nitrates, carbonates, bicarbonates, oxides, hydroxides and alkoxides of the above metal ions.

Illustrative examples of the random copolymers serving as components A1 and A2 of the invention include Nucrel AN4311, Nucrel AN4318 and Nucrel 1560 (all products of DuPont-Mitsui Polychemicals Co., Ltd.). Illustrative examples of the random copolymer neutralization products serving as components A3 and A4 of the invention include Himilan 1554, Himilan 1557, Himilan 1601, Himilan 1605, Himilan 1706, Himilan 1855, Himilan 1856, Himilan AM7315, Himilan AM7316, Himilan AM7317, Himilan AM7318 and Himilan AM7331 (all products of DuPont-Mitsui Polychemicals Co., Ltd.), and Surlyn 6320, Surlyn 7930, Surlyn 8120, Surlyn 8150, Surlyn 8220 and Surlyn 9150 (all products of E.I. DuPont de Nemours & Co.).

In the practice of the invention, the random copolymer and/or neutralization product thereof (component A) used as the base resin may be one of these alone or may be a combination of both the random copolymer with a neutralization product thereof. If both are used in combination, the proportions therebetween are not subject to any particular limitation.

In the invention, it is preferable for the base resin (component A) to be (A1) an olefin-unsaturated carboxylic acid random copolymer and/or (A3) a metal ion neutralization product of an olefin-unsaturated carboxylic acid random copolymer. The reason is that, although using the subsequently described branched saturated fatty acid with the above metal ion neutralization product of a binary copolymer serving as component A is essential for imparting the inventive golf ball with a soft feel and an excellent scuff resistance, a binary copolymer more easily plasticizes the overall cover material than does a ternary copolymer.

The copolymer or metal ion neutralization product serving as component A has a Shore D hardness which, while not subject to any particular limitation, is preferably at least 45, more preferably at least 48, and even more preferably at least 50. Given that component A serves as the base resin of the cover material and that the material hardness of the base resin is largely responsible for the hardness, durability and scuff resistance of the ball, it is desirable to set the Shore D hardness of component A within the foregoing range.

In the practice of the invention, a branched saturated fatty acid or a derivative thereof is used as component B. The number of carbons on one molecule of this branched saturated fatty acid is preferably at least 5, more preferably at least 6, and even more preferably at least 7. It is recommended that the upper limit be preferably not more than 40, and more preferably not more than 30.

A branched saturated fatty acid or a derivative thereof is used as component B because a greater hardness-lowering effect on the cover base resin can be achieved in this way than with an ordinary straight-chain saturated fatty acid (e.g., stearic acid, which has 18 carbons), enabling a soft feel on impact to be readily imparted to the cover. Moreover, branched saturated fatty acids are generally liquid and thus have a high molecular mobility, in addition to which they have no unsaturated bonds. By using the above materials in the practice of the invention, the base resin can be plasticized in a very stable state with respect to heat. Moreover, unsaturated fatty acids such as oleic acid readily incur oxidation under the effect of heat, resulting in greater discoloration and considerable deterioration at the surface of the cover. By contrast, when a branched saturated fatty acid or a derivative thereof is used, significant deterioration in the degree of whiteness does not occur.

Preferably, the branched saturated fatty acid used as component B is selected from among higher iso-fatty acids such as isostearic acid (18 carbons), isoarachidic acid (20 carbons), isopalmitic acid (16 carbons), isomyristic acid (13 carbons) and isoheptanoic acid (7 carbons). These may be used singly or as combinations of two or more thereof.

A branched saturated fatty acid derivative in which the proton on the acidic group of a branched saturated fatty acid has been substituted may be used as component B. Examples of such fatty acid derivatives include metal soaps in which substitution has been carried out with a metal ion. Illustrative examples of metal ions that may be used in such a metal soap include $Li^+$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. $Ca^{++}$, $Mg^{++}$ and $Zn^{++}$ are especially preferred.

The amount of component B used per 100 parts by weight of component A is preferably at least 1 part by weight, more preferably at least 5 parts by weight, and even more preferably at least 10 parts by weight. At less than 1 part by weight, it may not be possible to lower the hardness of the ionomer resin to the desired hardness value. The upper limit in the amount of component B per 100 parts by weight of component A is preferably 40 parts by weight, more preferably 35 parts by weight, and even more preferably 30 parts by weight. Above this amount, component B is difficult to fully incorporate into the resin and tends to bleed.

As indicated above, an unsaturated fatty acid is included as component B in the invention, but the amount of this unsaturated fatty acid is relatively low and so should not lead to obstacles such as molding defects.

In the practice of the invention, a basic inorganic metal compound capable of neutralizing acid groups in above components A and B may be included, although such a compound need not serve as an essential component. When a basic inorganic metal compound is included, it neutralizes un-neutralized carboxyl groups within the ionomer resin and carboxyl groups in component B, thereby forming a metal salt. This results in strong crosslinkages, enhancing the scuff resistance. Moreover, by using a basic inorganic metal compound to neutralize acid groups in above components A and B, the rebound resilience and processability can be freely controlled.

Illustrative examples of the metal ion used in the basic inorganic metal compound include $Li^+$, $Na^+$, $K^+$, $Ca^{++}$, $Mg^{++}$, $Zn^{++}$, $Al^{+++}$, $Ni^+$, $Fe^{++}$, $Fe^{+++}$, $Cu^{++}$, $Mn^{++}$, $Sn^{++}$, $Pb^{++}$ and $Co^{++}$. Basic inorganic fillers containing these metal ions may be used as the inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. The use of calcium hydroxide, which has a high reactivity with the ionomer resin, is especially preferred.

The basic inorganic metal compound is included in an amount, per 100 parts by weight of component A, of preferably at least 1 part by weight, more preferably at least 1.2 parts by weight, and even more preferably at least 1.5 parts by weight. Below this amount, the degree of neutralization falls shorts and a sufficient rebound resilience cannot be achieved. The upper limit in the amount of the basic inorganic metal compound per 100 parts by weight of component A is preferably not more than 10 parts by weight, more preferably not more than 7 parts by weight, and even more preferably not more than 6 parts by weight.

Other materials may be suitably included in the mixture of components A and B, although it is recommended that the mixture have a melt mass flow rate (measured in accordance with JIS-K7210 at a test temperature of 190° C. and under a test load of 21 N (2.16 kgf)) of preferably at least 1.0 g/10 min, and more preferably at least 1.5 g/10 min, but preferably not more than 8 g/10 min, and more preferably not more than 5 g/10 min. If the melt mass flow rate of the hot mixture is too low, the processability will markedly decline.

Various additives may be optionally included in the mixture. For example, when the mixture is to be used as a cover material, additives such as pigments, dispersants, antidegradants, antioxidants, heat deterioration inhibitors and light stabilizers may be included therein. Exemplary antioxidants include (1) primary antioxidants such as phenolic compounds and amine compounds having a peroxy radical-scavenging effect, and (2) secondary antioxidants such as phosphorus compounds and sulfur having a peroxide-decomposing effect. Exemplary heat deterioration inhibitors include phenolic compounds and amine compounds having a carbon radical-scavenging effect. Examples of light stabilizers include benzotriazole, benzophenone, benzoate, triazine, cyanoacrylate and hindered amine compounds.

Moreover, to improve the feel of the ball on impact, in addition to the foregoing essential ingredients, various non-ionomeric thermoplastic elastomers may be included in the above material. Examples of such non-ionomeric thermoplastic elastomers include olefin elastomers, styrene elastomers, ester elastomers, and urethane elastomers. The use of olefin elastomers and styrene elastomers is especially preferred.

The mixing method used to obtain the above mixture is not subject to any particular limitation. For example, mixture may be carried out at a heating temperature of from 150 to 250° C. using as the mixing apparatus an internal mixer such as a kneading-type twin-screw extruder, a Banbury mixer or a kneader. No limitation is imposed on the method of incorporating the various additives other than above essential Components A and B. Examples include a method in which the additives are compounded with the above essential components and simultaneously mixed under applied heat, and a method in which the essential components are first mixed under heating, then the optional additives are added, followed by additional mixing under applied heat. In particular, when a co-rotating twin-screw extruder is used, the unsaturated fatty acid may be injected from various vent ports on the twin-screw extruder using a plunger-type pump. The basic inorganic metal compound may be added from any desired point using a side feed.

To obtain the cover in the invention, use may be made of a method which involves placing within a mold a single-layer core or a multi-layer core of two or more layers that has been pre-fabricated according to the type of ball, mixing and melting the above mixture under applied heat, and injection-molding the molten mixture so as to encase the core within the desired cover. In this way, the cover-forming operation can be carried out in a state that ensures an outstanding heat stability, flow and moldability, enabling the golf ball ultimately obtained to have a high rebound resilience and also a good feel on impact and excellent scuff resistance. Alternatively, the method used to form the cover may be one in which, first, a pair of hemispherical half-cups is molded from the cover material of the invention, following which the half-cups are placed over a core and molded under pressure at 120 to 170° C. for 1 to 5 minutes.

In the practice of the invention, the cover is not limited to one layer only, and may instead be formed so as to have a multilayer structure of two or more layers. If the cover has one layer, the thickness is preferably from 0.5 to 3 mm. If the cover has two layers, it is preferable for the outer cover layer to have a thickness in a range of 0.5 to 2.0 mm and the inner cover layer to have a thickness in a range of 0.5 to 2.0 mm. When the cover has a multilayer structure, the cover material of the invention may be used either at the inner side of the multilayer structure or in the outermost cover layer. However, in the present invention, use as the outermost layer is preferred. That is, when the cover is formed of two or more layers, to obtain a good feel and to provide an even better scuff resistance, it is advantageous for a molded material obtained from the mixture containing above components A and B to be used as the chief material of the outermost layer.

It is desirable for the respective layers making up the cover (cover layers) to have a Shore D hardness of at least 40, and preferably at least 45, but not more than 65, and preferably not more than 63.

The surface of the outermost layer of the cover may have a plurality of dimples formed thereon, and the cover may be administered various treatments, such as surface preparation, stamping and painting. In particular, when such surface treatment is administered to a golf ball cover made of the cover material of the invention, the ease of operation is good on account of the good moldability of the cover surface.

The present invention provides a golf ball in which a material obtained by molding the above mixture is used in at least one cover layer. The type of golf ball is not subject to any particular limitation, provided the ball has a core and at least one cover layer. Exemplary golf balls include solid golf balls, such as solid two-piece and three-piece golf balls having a core encased by a cover, and solid multi-piece golf balls with a construction of three or more layers; and also thread-wound golf balls having a thread-wound core encased by a cover of one layer or having a multilayer construction of two or more layers.

The golf ball of the invention, which can be manufactured so as to conform with the Rules of Golf for competitive play, may be produced to a ball diameter of not less than 42.67 mm and a weight of not more than 45.93 g. The golf ball of the invention may be suitably used in all competitive play, whether by amateur golfers having a head speed of 30 to 40 m/s or by professional golfers having a head speed of 45 m/s.

The golf ball of the invention uses as the core a material of exceptional resilience that has been molded under heat from a rubber composition, as a result of which the ball as a whole has an excellent rebound. Moreover, the golf ball of the invention has a soft, pleasant feel on impact and excellent scuff resistance while retaining a good flight performance. In addition, the inventive ball has an appearance with a high degree of whiteness.

EXAMPLES

The following Examples and Comparative Examples are provided by way of illustration and not by way of limitation.

Examples 1 and 2, Comparative Examples 1 to 5

Using a core material composed primarily of the polybutadiene shown in Table 1 below, a solid core having a diameter of 36.6 mm, a weight of 31.3 g, and a deflection adjusted to 3.6 mm or 3.7 mm was produced. The deflection was the measured amount of deformation by the core when compressed under a final load of 1,275 N (130 kgf) from an initial load of 98 N (10 kgf).

TABLE 1

| | | Core No. | | | |
|---|---|---|---|---|---|
| | | No. 1 | No. 2 | No. 3 | No. 4 |
| Formulation (pbw) | Polybutadiene EC140 | 100 | | | |
| | Polybutadiene BR51 | | 100 | | |
| | Polybutadiene BR60 | | | 100 | |
| | Polybutadiene BR01 | | | | 100 |
| | Peroxide | 0.4 | 0.4 | 0.4 | 0.4 |
| | Zinc oxide | 30.6 | 30.6 | 30.6 | 30.6 |
| | Antioxidant | 0.2 | 0.2 | 0.2 | 0.2 |
| | Zinc diacrylate | 28.5 | 28.5 | 28.5 | 28.5 |
| | Zinc stearate | 5 | 5 | 5 | 5 |
| | Zinc salt of pentachlorothiophenol | 1 | 1 | 1 | 1 |
| | Specific gravity | 1.2 | 1.2 | 1.2 | 1.2 |
| Properties | Diameter (mm) | 36.6 | 36.6 | 36.6 | 36.6 |
| | Weight (g) | 31.3 | 31.3 | 31.3 | 31.3 |
| | Deflection (mm) | 3.6 | 3.6 | 3.6 | 3.7 |

Details of the above formulation are provided below.

Polybutadiene rubber:

"EC140" (trade name), available from Firestone Polymers. Polymerized with a neodymium catalyst; Mooney viscosity, 43; $T_{80}$ value, 2.3.

Polybutadiene rubber:

"BR51" (trade name), available from JSR Corporation. Polymerized with a neodymium catalyst; Mooney viscosity, 39; $T_{80}$ value, 5.0.

Polybutadiene rubber:

"BR60" (trade name), available from Polimeri Srl. Polymerized with a neodymium catalyst; Mooney viscosity, 57; $T_{80}$ value, 4.6.

Polybutadiene rubber:

"BR01" (trade name), available from JSR Corporation. Polymerized with a nickel catalyst; Mooney viscosity, 48; $T_{80}$ value, 8.4.

Peroxide: Dicumyl peroxide, available from NOF Corporation under the trade name "Percumyl D".

Zinc oxide: Available from Sakai Chemical Industry Co., Ltd. under the trade name "Sanshu Sanka Aen"; average particle size, 0.6 μm (air permeametry).

Antioxidant: "Nocrac NS-6" (trade name), available from Ouchi Shinko Chemical Industry Co., Ltd.

Zinc diacrylate: Available from Nippon Shokubai Co., Ltd.

Zinc stearate: "Zinc Stearate G" (trade name), available from NOF Corporation.

Next, an inner cover layer material of the composition shown in Table 2 was injection-molded to a thickness of 1.55 mm in a mold within which the above solid core had been placed. The outer cover layer material shown in Table 3 was then mixed in a co-rotating twin-screw extruder (screw diameter, 32 mm; L/D=32; motor capacity, 7.5 kw; with vacuum vent) at 200° C.; the resulting mixture was injected into a mold within which the inner cover layer material-encased core had been placed, and injection-molded to an outer cover layer thickness of 1.5 mm, thereby producing a three-piece solid golf ball having a diameter of 42.7 mm. The surface of the golf ball obtained in each example was coated with a non-yellowing urethane resin-based paint. The properties (initial velocity, feel on impact, scuff resistance, etc.) of the golf balls obtained in each example were evaluated as described below. The results are presented in Table 4.

TABLE 2

| | | Amount (pbw) |
|---|---|---|
| Formulation | AM7331 | 85 |
| | Dynaron 6100P | 15 |
| | Behenic acid | 20 |
| | Calcium hydroxide | 2.9 |
| | Calcium stearate | 0.15 |
| | Zinc stearate | 0.15 |
| Specific gravity | | 0.95 |
| Weight (g) | | 6.74 |
| Properties* | Diameter (mm) | 39.7 |
| | Weight (g) | 38.0 |
| | Deflection (mm) | 3.3 |

*For a sphere composed of the core encased by the inner cover layer.

Details of the above formulation are provided below.

AM7331: An ionomer resin of ethylene-methacrylic acid-acrylic acid ester copolymer neutralized with sodium ions (available from DuPont-Mitsui Polychemicals Co., Ltd.).

Dynaron 6100P: A hydrogenated polymer (olefin-based thermoplastic elastomer) available from JSR Corporation.

Behenic acid: "NAA-222S" (trade name), available from NOF Corporation as a powder.

Calcium hydroxide: "CLS-B" (trade name), available from Shiraishi Calcium Kaisha, Ltd.

Calcium stearate: "Nissan Calcium Stearate" (trade name), available from NOF Corporation.

Zinc stearate: "Nissan Zinc Stearate" (trade name), available from NOF Corporation.

TABLE 3

| | | Cover formulation | | | |
|---|---|---|---|---|---|
| | | I | II | III | IV |
| Resin formulation | Himilan 1706 | 100 | 100 | 100 | |
| | Himilan 1855 | | | | 20 |
| | Himilan 1557 | | | | 30 |
| | AM7331 | | | | 50 |
| Fatty acid | Oleic acid | | | 20 | |
| | Isostearic acid - N | 20 | 30 | | |
| Neutralization source | Calcium hydroxide $Ca(OH)_2$ | 1 | 2.1 | 2 | |
| Additives | Titanium oxide $TiO_2$ | 3 | 3 | 3 | 3 |
| | Magnesium stearate Mg-St | | | | 1 |
| | Blue pigment | 0.05 | 0.05 | 0.05 | 0.05 |
| Properties | Melt flow rate (at 190° C.; g/10 min) | 2.7 | 2.6 | 2.0 | 2.1 |
| | Specific gravity | 0.98 | 0.98 | 0.99 | 0.97 |
| | Shore D hardness | 54 | 51 | 55 | 54 |

*Numbers indicated for the respective ingredients represents parts by weight.

Details of the above formulations are provided below.

(1) Himilan 1706 (trade name): Ionomer resin of 10 ethylene-methacrylic acid copolymer neutralized with zinc ions, available from DuPont-Mitsui Polychemicals Co., Ltd. (Shore D hardness, 64).

(2) Himilan 1855 (trade name): Ionomer resin of ethylene-methacrylic acid-acrylic acid ester copolymer neutralized with zinc ions (Shore D hardness, 55).

(3) Himilan 1557 (trade name): Ionomer resin of ethylene-methacrylic acid copolymer neutralized with zinc ions, available from DuPont-Mitsui Polychemicals Co., Ltd. (Shore D hardness, 59).

(4) AM7331 (trade name): Ionomer resin of ethylene-methacrylic acid-acrylic acid ester copolymer neutralized with sodium ions.

(5) Oleic acid: NAA-300 (trade name), available from NOF Corporation.

(6) Isostearic acid-N: Higher iso-fatty acid available from Nissan Chemical Industries, Ltd., and having the following structural formula.

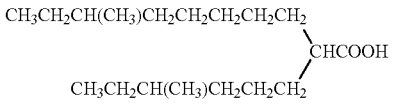

(7) Calcium hydroxide: CLS-B (trade name), available from Shiraishi Calcium Kaisha, Ltd.

(8) Magnesium stearate: Nissan Magnesium Stearate (trade name), available from NOF Corporation.

(9) Blue pigment: Ultramarine Blue EP-62 (trade name), available from Holliday Pigments.

(10) Titanium oxide: Tipaque R550 (trade name), available from Ishihara Sangyo Kaisha, Ltd.

Evaluation of Cover Material Properties

Melt Mass Flow Rate:

The melt mass flow rate (or melt index) of the material, as measured in accordance with JIS-K7210 (test temperature, 190° C.; test load, 21 N (2.16 kgf)).

Hardness of Cover Material:

The Shore D hardness measured according to ASTM D-2240 is shown.

TABLE 4

| | Example | | Comparative example | | | | |
|---|---|---|---|---|---|---|---|
| | 1 | 2 | 1 | 2 | 3 | 4 | 5 |
| Core | No. 1 | No. 1 | No. 1 | No. 1 | No. 2 | No. 3 | No. 4 |
| Outer cover layer | I | II | III | IV | I | I | I |
| Diameter (mm) | 42.7 | 42.7 | 42.7 | 42.7 | 42.7 | 42.7 | 42.7 |
| Weight (g) | 45.5 | 45.5 | 45.4 | 45.4 | 45.5 | 45.5 | 45.5 |
| Deflection (mm) | 3.2 | 3.2 | 3.2 | 3.2 | 3.2 | 3.2 | 3.3 |
| Initial velocity (m/s) | 76.7 | 76.9 | 77.1 | 77 | 76.5 | 76.5 | 76.3 |
| Scuff resistance | 3.6 | 3.5 | 4.2 | 3.2 | 3.6 | 3.6 | 3.6 |
| Appearance (whiteness) | good | good | NG | good | good | good | good |

[Evaluation of Ball Properties]

Ball Deflection (mm)

The amount of deformation (mm) by the golf ball when compressed under a final load of 1,275 N (130 kgf) from an initial load state of 98 N (10 kgf) was determined.

Initial Velocity of Ball (m/s)

The initial velocity (m/s) was measured using an initial velocity measuring apparatus of the same type as that of the official golf ball regulating-body—R&A (USGA), and in accordance with R&A (USGA) rules.

Scuff Resistance

A non-plated X-WEDGE 03 (loft, 52°) manufactured by Bridgestone Sports Co., Ltd. was set in a swing robot, and the ball was hit at a head speed of 33 m/s with the club face open about 30° from square. The surface state of the ball was then visually examined by three golfers having handicaps of 10 or less, and rated according to the following criteria. The average of the ratings obtained for each example is shown in the table.

5: Surface of ball is either completely unchanged or bears a slight imprint from club face.

4: Surface of ball bears a clear imprint from club face, but is not frayed.

3: Surface is conspicuously frayed and scuffed.

2: Surface is frayed and cracked.

1: Some dimples have been obliterated.

Appearance (Whiteness)

The whiteness of the ball surface was visually checked and rated according to the following criteria.

Good: white

Fair: Not sufficiently white

Poor: yellow

The invention claimed is:

1. A golf ball comprising a core and a cover of one or more layer, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide, and wherein at least one layer of the cover is made of a material obtained by molding a mixture comprising (A) 100 parts by weight of a base resin and (B) 1 to 40 parts by weight of a branched saturated fatty acid or a derivative thereof.

2. The golf ball of claim 1, wherein the rubber composition further comprises (d) an organosulfur compound.

3. The golf ball of claim 1, wherein the polybutadiene having a stress relaxation time ($T_{80}$) of 3.5 or less accounts for at least 40 wt % of the base rubber.

4. The golf ball of claim 1, wherein the polybutadiene having a stress relaxation time ($T_{80}$) of 3.5 or less is a polybutadiene prepared using a rare-earth catalyst.

5. The golf ball of claim 1, wherein the polybutadiene having a stress relaxation time ($T_{80}$) of 3.5 or less is a polybutadiene prepared by polymerization using a rare-earth catalyst, followed by terminal modification.

6. The golf ball of claim 1, wherein the mixture comprising components A and B further comprises a basic inorganic metal compound capable of neutralizing acid groups in components A and B.

7. The golf ball of claim 1, wherein the base resin (A) is one or more selected from among (A1) to (A4) below:

(A1) olefin-unsaturated carboxylic acid random copolymers, (A2) olefin-unsaturated carboxylic acid-unsaturated carboxylic acid ester random copolymers, (A3) metal ion neutralization products of olefin-unsaturated carboxylic acid random copolymers, and (A4) metal ion neutralization products of olefin-unsaturated carboxylic acid-unsaturated carboxylic acid ester random copolymers.

8. The golf ball of claim 1, wherein the base resin (A) is (A1) an olefin-unsaturated carboxylic acid random copolymer and/or (A3) a metal ion neutralization product of an olefin-unsaturated carboxylic acid random copolymer.

9. The golf ball of claim 1, wherein an outermost layer of the cover is made of the material obtained by molding the mixture comprising components A and B.

10. The golf ball of claim 1, wherein the branched saturated fatty acid (B) is at least one selected from the group consisting of isostearic acid, isoarachidic acid, isopalmitic acid, isomyristic acid and isoheptanoic acid.

* * * * *